US006722748B2

(12) United States Patent
Eichmann et al.

(10) Patent No.: US 6,722,748 B2
(45) Date of Patent: Apr. 20, 2004

(54) SEWING ACCESSORIES BOX

(75) Inventors: Jurg Eichmann, Diepoldsau (CH); Richard Amiel, Rheineck (CH)

(73) Assignee: Fritz Gegauf AG Bernina-Nähmaschinenefabrik, Steckborn (CH)

( * ) Notice: Subject to any disclaimer, the term of this patent is extended or adjusted under 35 U.S.C. 154(b) by 456 days.

(21) Appl. No.: 09/862,528

(22) Filed: May 22, 2001

(65) Prior Publication Data

US 2002/0011765 A1 Jan. 31, 2002

(30) Foreign Application Priority Data

May 26, 2000 (CH) ..... 1069/00

(51) Int. Cl.[7] ..... A47B 81/00
(52) U.S. Cl. ..... 312/208.6; 312/311
(58) Field of Search ..... 312/208.5, 208.6, 312/72, 309, 310, 311, 333, 223.2; 112/1

(56) References Cited

U.S. PATENT DOCUMENTS 3,744,673 A * 7/1973 Lahmann ..... 312/72
4,088,380 A * 5/1978 Watts ..... 312/306
4,339,164 A * 7/1982 Spevak ..... 312/305
4,382,641 A * 5/1983 Abel ..... 312/313
RE32,184 E * 6/1986 Doyel ..... 223/107
4,620,652 A * 11/1986 Hanlon ..... 312/72
4,669,790 A * 6/1987 Briggs ..... 312/223.3
4,738,580 A * 4/1988 Kraske ..... 312/72
5,282,679 A * 2/1994 Redelinghuys ..... 312/316
5,464,280 A * 11/1995 Runger ..... 312/249.11
5,601,541 A * 2/1997 Swisher ..... 604/322
5,794,913 A * 8/1998 Ho ..... 248/688
5,795,044 A * 8/1998 Trewhella et al. ..... 312/333

FOREIGN PATENT DOCUMENTS

GB 7183 * 3/1887 ..... 312/311
SE 166417 * 3/1959 ..... 312/208.5

* cited by examiner

*Primary Examiner*—Lanna Mai
*Assistant Examiner*—Hanh V. Tran
(74) *Attorney, Agent, or Firm*—Edwin D. Schindler

(57) ABSTRACT

A sewing accessories box includes a bottom part, as a set-up base, a back wall, a front wall, which is designed as a door, two side walls, a deck and interior shelves, which serve as receiving shelves for receiving accessories, such as bobbins or presser feet for a sewing machine. Each individual accessory is able to be retained in a holding and transport position on the receiving shelf so that, by way of actuation by a release key or by a swivelling movement of an individual accessory, the accessory can be moved from its holding and transport position into a removal position.

19 Claims, 6 Drawing Sheets

SEWING ACCESSORIES BOX

BACKGROUND OF THE INVENTION

1. Technical Field of the Invention

The present invention relates, generally, to a sewing machine accessory box.

More particularly, the present invention relates to a sewing machine accessory box having a bottom part, as a set-up base, a back wall, a front wall, which is designed as a door, two side walls, a deck and interior shelves, which serve as receiving shelves for receiving accessories, such as bobbins or presser feet for a sewing machine. Each individual accessory is able to be retained in a holding and transport position on the receiving shelf so that, via actuation by a release key or via a swivelling movement of an individual accessory, the accessory can be moved from its holding and transport position into a removal position.

2. Description of the Prior Art

Sewing accessory boxes serve the purpose of storing sewing utensils, such as upper and lower bobbins, presser feet and any additional tools required for servicing the sewing machine. Different varieties of such accessory boxes have been known for many years. The accessory boxes are, in most cases, a component of the case in which the sewing machine is stored when not in use.

U.S. Design Pat. No. D 249,947 discloses a sewing accessory box having two parts, i.e., a first part for receiving the rear portion of the sewing machine and a second part for receiving the front portion thereof. The sewing utensils are plugged on, or inserted in, fixed holding means in the rear portion of the box. This prior art sewing utensils box can only be closed when the sewing machine is jointly stored away together with the second part of the case. Furthermore, this sewing accessory box is linked with the sewing machine by a joint and may, therefore, interfere with the operation of the sewing machine itself.

Switzerland Patent Specification No. 257,090 discloses a portable device for storing sewing utensils in the form of a case. This case can be opened in a standing position on one of its narrow sides and, in this manner, provides access to the bobbins and other utensils, which are arranged in the interior, mounted on suitable take-up pins. The arrangement for holding utensils, particularly, bobbins, is predetermined in this prior art device and no individual division or expansion is possible.

SUMMARY OF THE INVENTION

It is, therefore, an object of the present invention to provide a sewing accessories box that can be used as part of the sewing machine case and also as an independently usable box with doors.

It is a further object of the present invention to provide a sewing accessories box in which the take-up shelves in the accessories box allow for accessories to be stowed therein which will not become detached during transport, i.e., that such accessories are retained in place, yet can be easily and individually removed, as required.

The foregoing and related objects are achieved by the sewing accessories box of the present invention, which includes a bottom part, as a set-up base, a back wall, a front wall, which is designed as a door, two side walls, a deck and interior shelves, which serve as receiving shelves for receiving accessories, such as bobbins or presser feet for a sewing machine. Each individual accessory is able to be retained in a holding and transport position on the receiving shelf so that, via actuation by a release key or via a swivelling movement of an individual accessory, the accessory can be moved from its holding and transport position into a removal position.

The sewing accessory box in accordance with the present invention can be set up during sewing next to, or behind, the sewing machine, and the utensils stored therein can be removed from the take-up shelves at any time. The utensils are retained within the take-up shelf by suitable means and can only be removed by prior release of a release mechanism or via means for a swivelling movement. The numbers and designations attached to the small presser feet are made visible by the take-up shelves, as defined by the invention. Similarly, the quantity and color of the thread on the bobbins can be directly visualized from the front. The sewing accessory box, when suspended, can also be used as a wall cabinet.

It is possible to store the sewing accessory box, not only in the position of use, but it can also be readily turned over without causing disarrangement in its interior. The lower thread bobbins are retained in their positions by elastic holding means and can be released for removal by pressing a key without causing them to drop out of the take-up shelf. Other utensils, such as presser feet, are suspended on suitably designed hooks and can be moved from the holding position into the removal position by a swivelling movement.

The take-up means are not arranged fixed in the box, but may be exchanged, if so required. They are mounted on racks and can be pushed into the box and locked therein. In this manner, the interior of the sewing accessory box can be individually adapted to the user's own requirements at any time. The (at least) one foot, which can be integrated in the bottom, or in the back wail, of the accessory box, permits the very slim box to be safely set up on a table. The sewing accessory box can be secured on the back side of the sewing machine when not in use or accommodated within the case. The box can be locked in an advantageous manner on the back side of the sewing machine.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1:
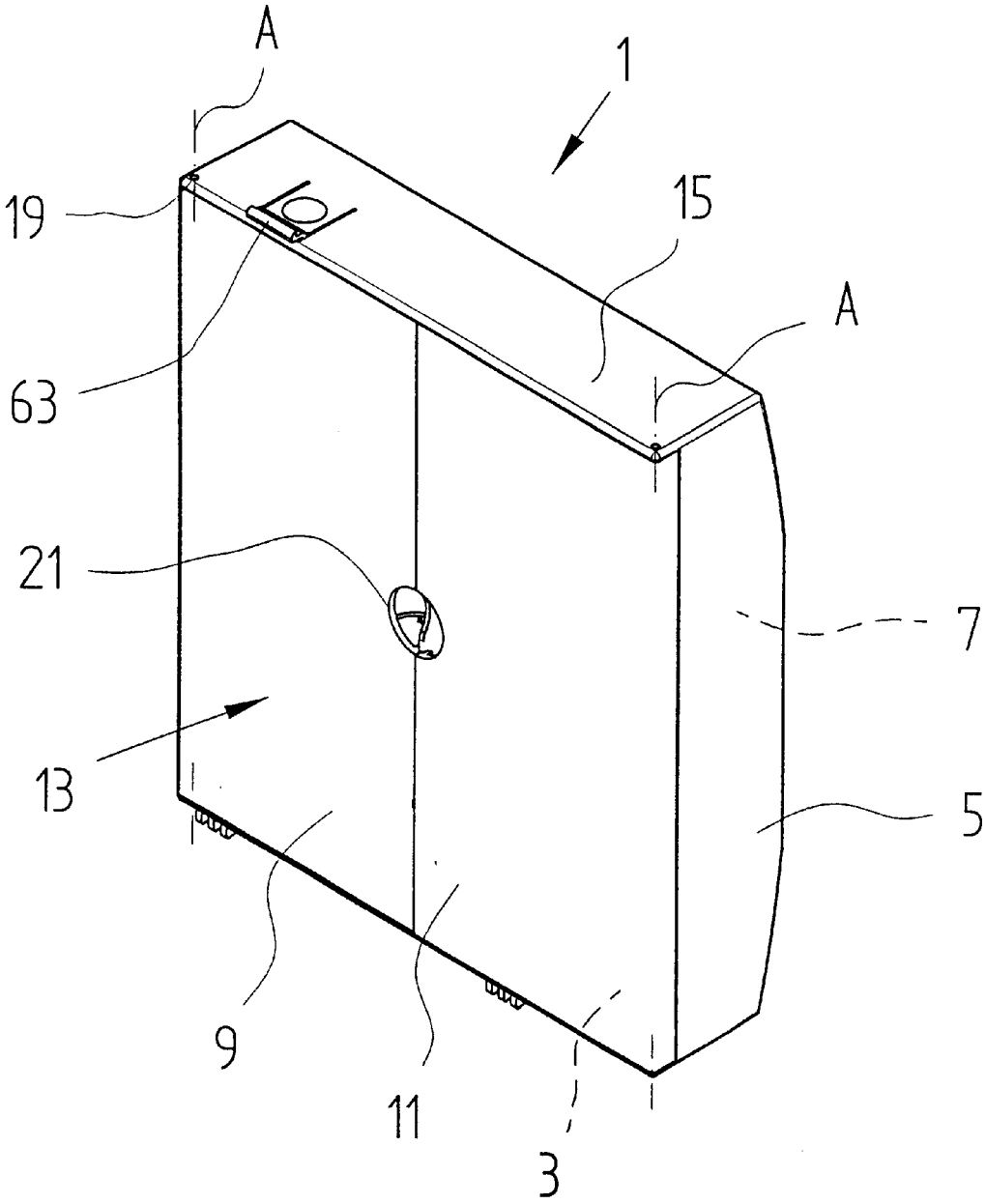
FIG. 1 is a perspective, front view of a sewing accessories box of the present invention.
Figure 2:
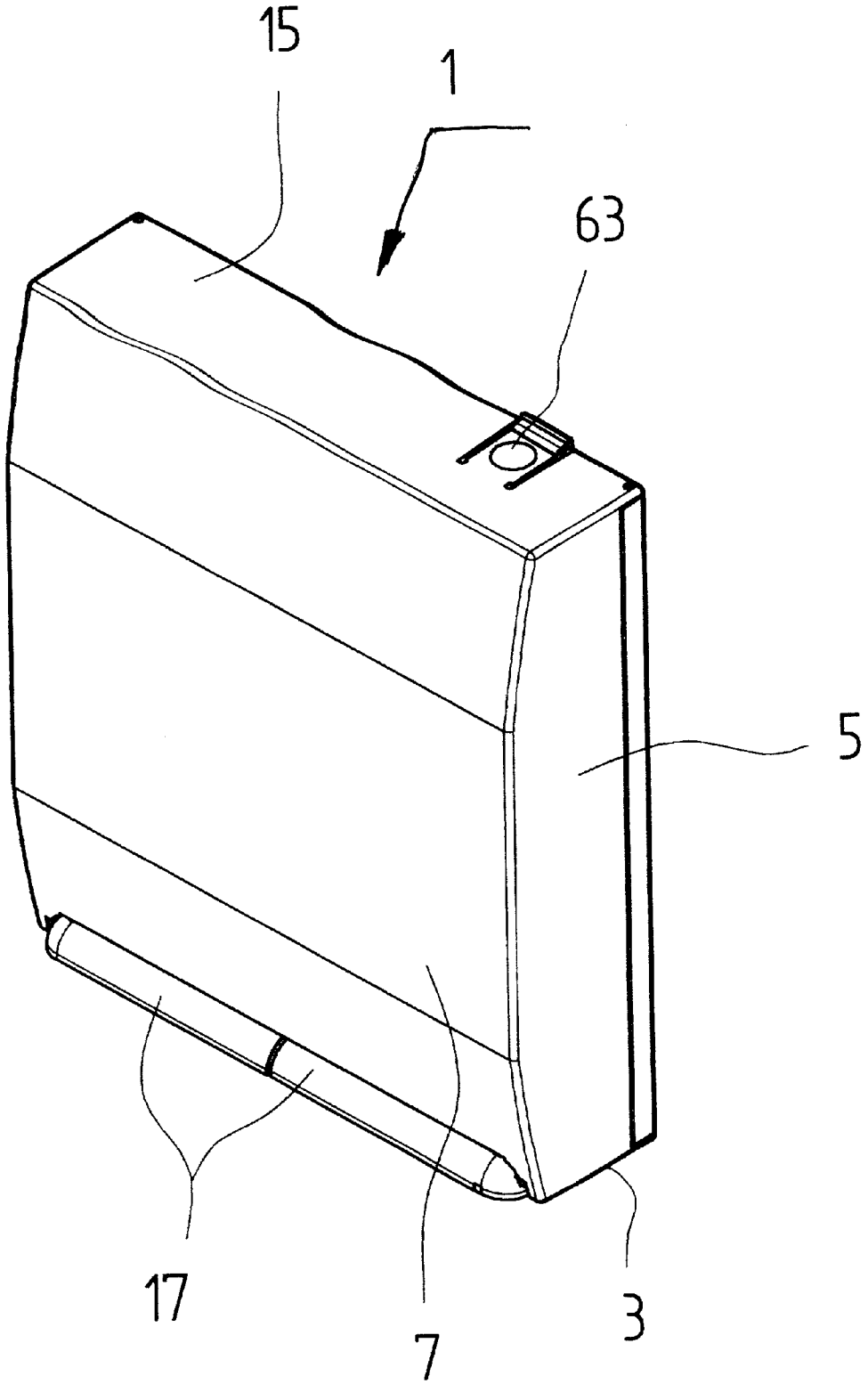
FIG. 2 is a perspective, rear view of the sewing accessories box of FIG. 1.

Turning now, in detail, to an analysis of the accompanying drawing figures, a sewing accessory box, denoted by reference numeral 1, is also referred to herein as box 1, comprises a bottom 3, which is adjoined by two narrow side walls 5, a back wall 7, as well as a front wall 13, which is formed by two doors 9, 11. At the top, box 1 is closed by a deck 15. Two support feet 17, pivoting about substantially vertical axes, are secured underneath the bottom 3, or partially embedded in the latter.

Figure 3:
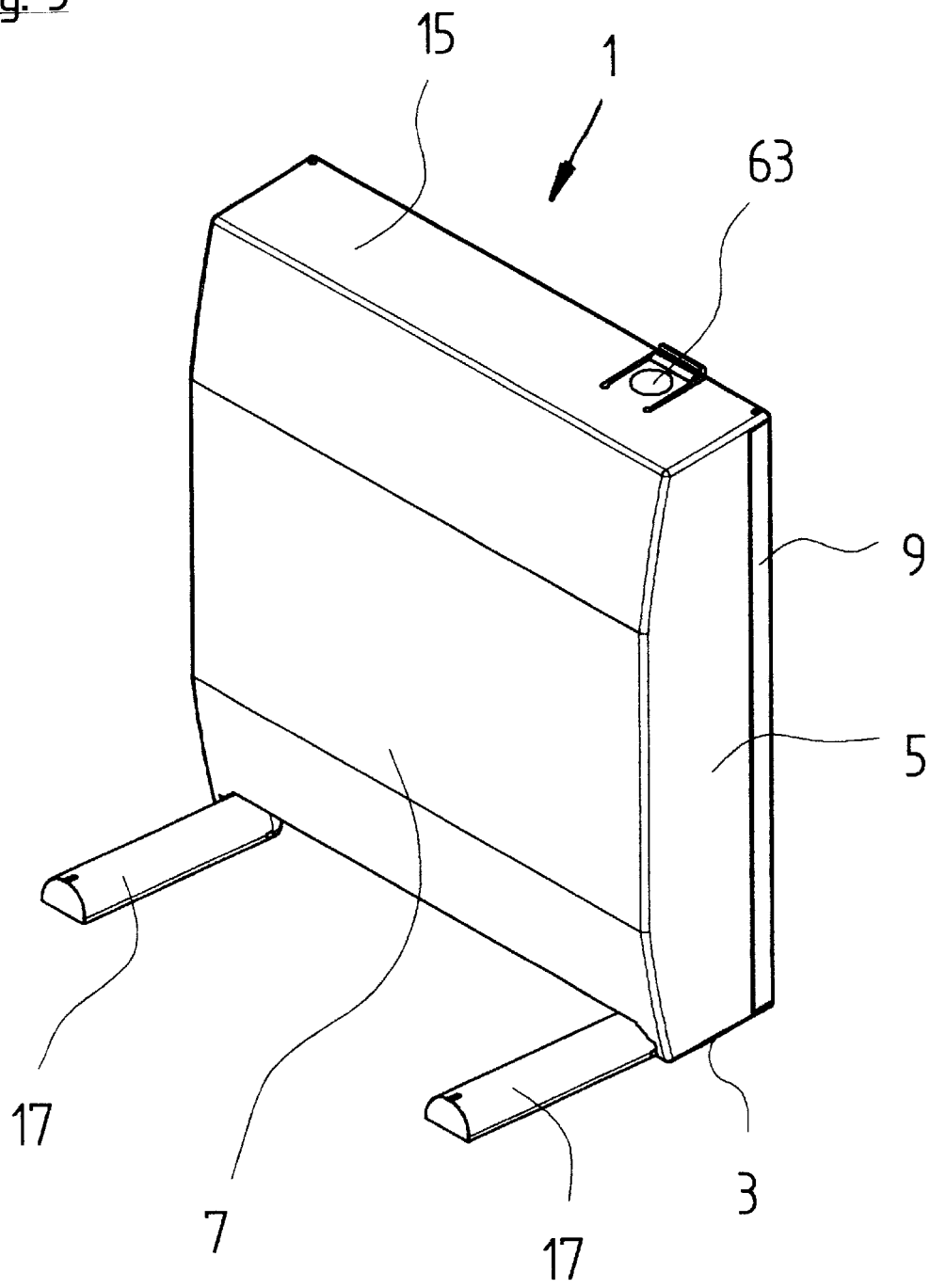
FIG. 3 is a perspective view of the sewing accessories box with extended feet.

In the completely extended position (see, FIG. 3), support feet 17 are substantially set at right angles in relation to back wall 7 of box 1. As an alternative, at least one support foot 17 may be also be pivoted about a horizontal axis, whereby said axis is spaced from the bottom 3, so that swinging into the support position is possible (not shown.) Doors 9, 11 are each pivot-mounted, swinging about a substantially vertically extending axis A. The pivots 19, which are formed on doors 9, 11, accordingly, and disposed on axis A, are hinged on deck 15 and on the bottom 3. A recess 21, or a handle on each of the doors 9, 11, permits the latter to be opened. A closure, which retains doors 9, 11 in the closed position, is not visible.

Figure 4:
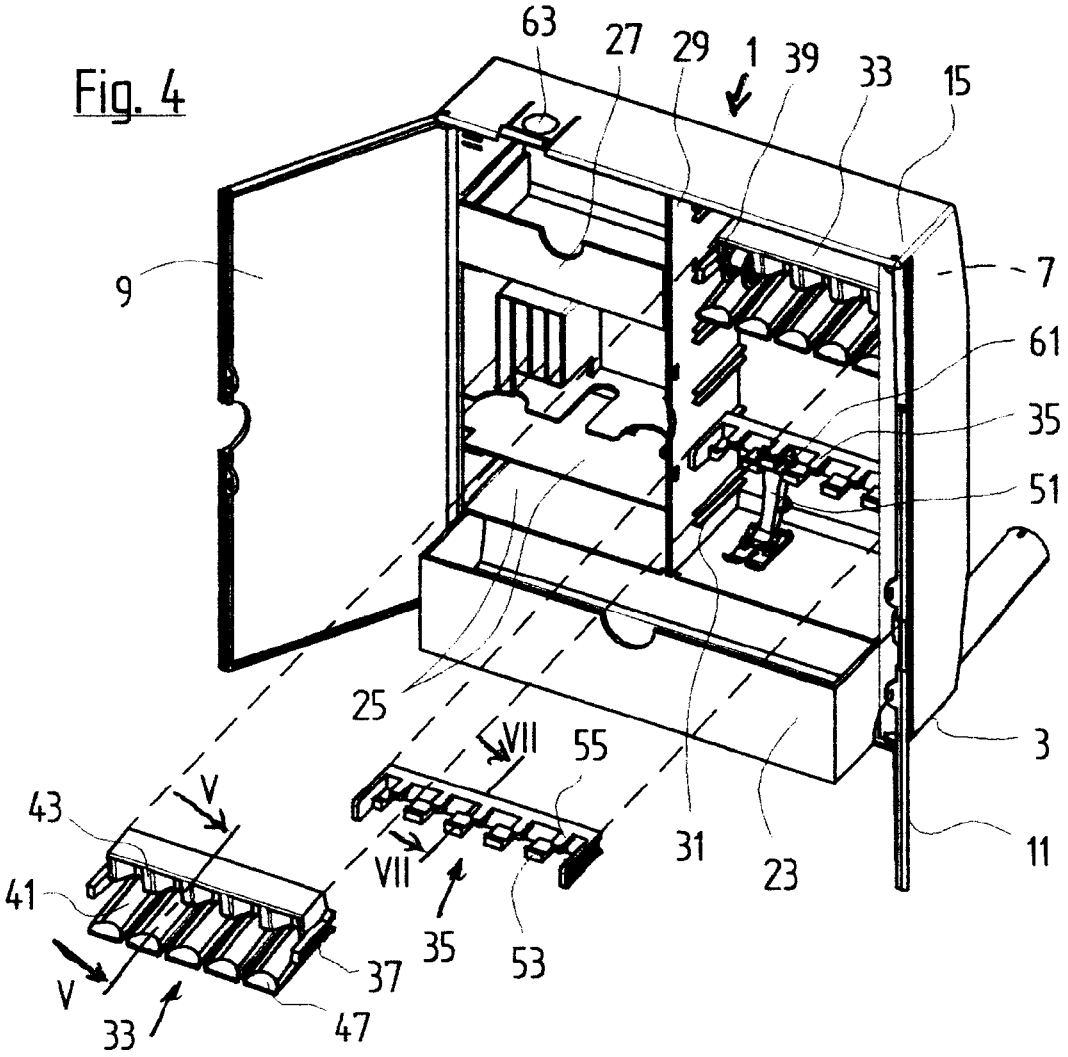
FIG. 4 is a front, perspective view of the sewing accessories box of the present invention with its doors open.

FIG. 4 shows box 1 with doors 9, 11 open and permits a view of the interior. A drawer 23, for loosely storing other utensils, may be inserted above the bottom 3. The shelves 25, for example, and another drawer 27 are located on top of the left side. The substantially horizontally extending rails 31 are secured, or injection-molded, on the right-hand side in the exemplified embodiment of box 1, which is divided by a vertical partition 29. The shelves 33, in the form of a rack, for example, for receiving the lower thread bobbin 39, and the shelves 35 for receiving the small presser feet 51 and other components required during sewing, are inserted on said rails. The two shelves 33, 35 for receiving the lower threaded bobbins 39 and the small presser feet 51, which are only shown by way of example, have the lateral guide elements 37 (e.g., grooves), which can be inserted into the rails 31 and, preferably, locked into the latter.

Figure 5:
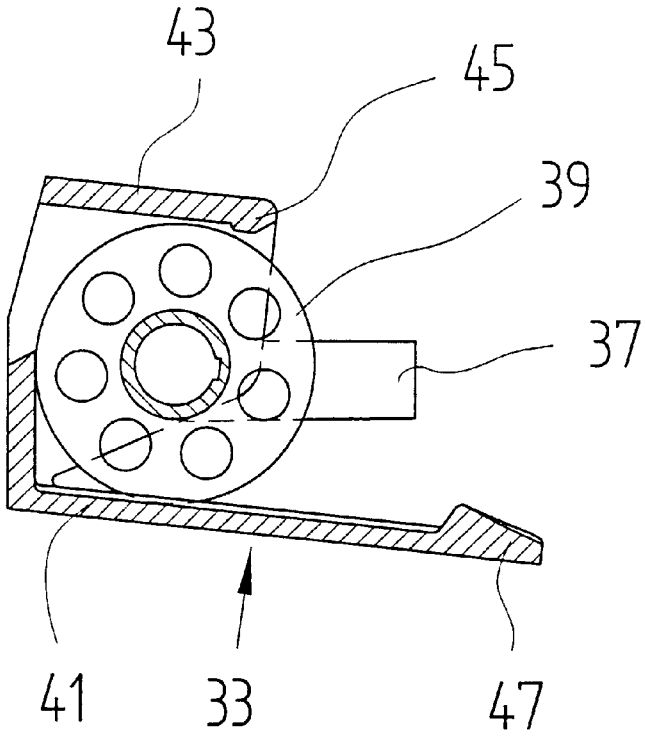
FIG. 5 is a cross-sectional view of the sewing accessories box of the present invention, taken through the take-up shelf for lower thread bobbins in the holding position along line V—V of FIG. 4.
Figure 6:
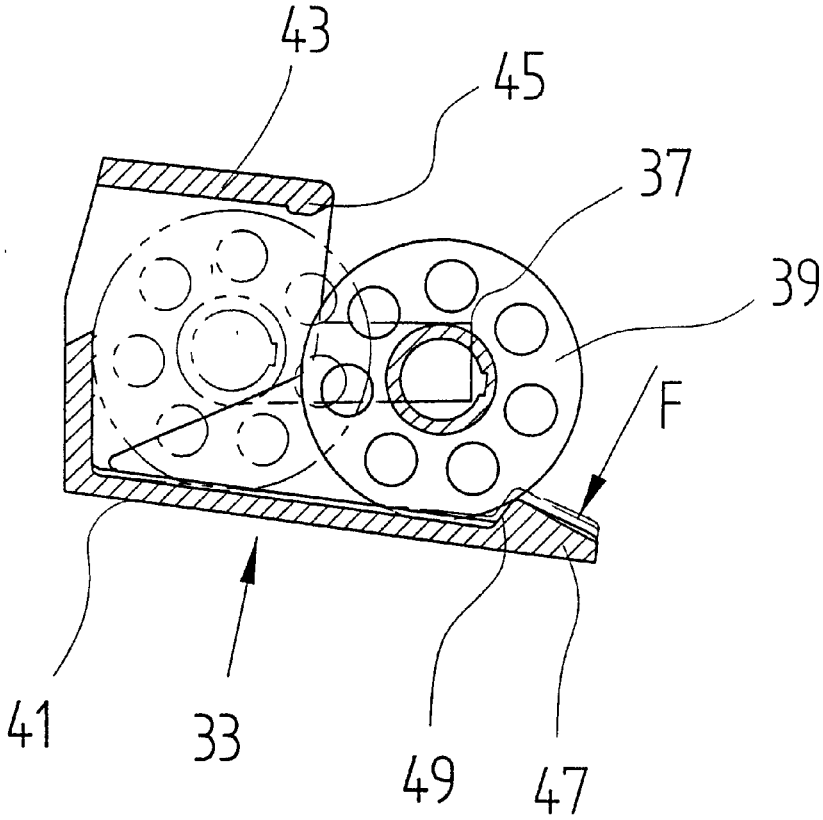
FIG. 6 is a cross-sectional view taken through the take-up shelf for lower thread bobbins in the removal position.

The shelves 33, for receiving the lower thread bobbins 39 (see, FIGS. 5 and 6) have a C-shaped cross-section, whereby the spacing between the lower (and longer) elastic leg 41 and the upper, shorter leg 43, is only slightly greater than the diameter of the lower thread bobbins 39. A rib 45, extending parallel with the axis of the lower thread bobbin 39, is formed on the front end of the upper leg. Rib 45 retains the lower thread bobbin 39 in the pushed-in position by forces acting radially on its periphery, or prevents it from rolling forward. The lower leg 41 is, preferably, inclined in relation to the horizontal, and its front end may be provided with a key 47, whose rearward edge 49 serves as a stop for the lower thread bobbin 39, when the latter, via a force F applied to key 47, rolls from the locked holding position (see, FIG. 5) into the removal position (see, FIG. 6.)

Each of the receiving shelves 33 contains a multitude of individually serviceable take-up places arranged next to each other, each for one lower threaded bobbin 39.

Figure 7:
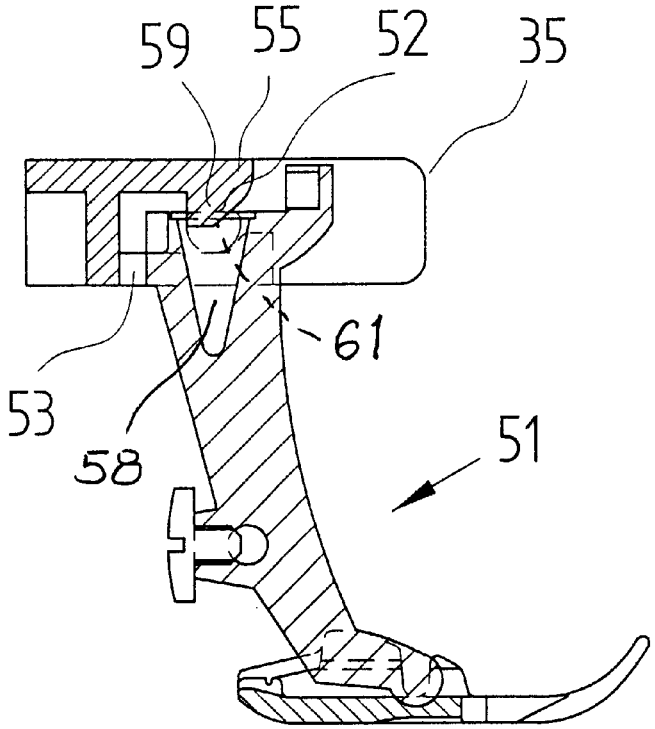
FIG. 7 shows a receptacle for presser feet with a presser foot in the holding position, taken along line VII—VII of FIG. 4; and, FIG. 8 shows a receptacle for small presser feet with a presser foot in the removal position.
Figure 8:
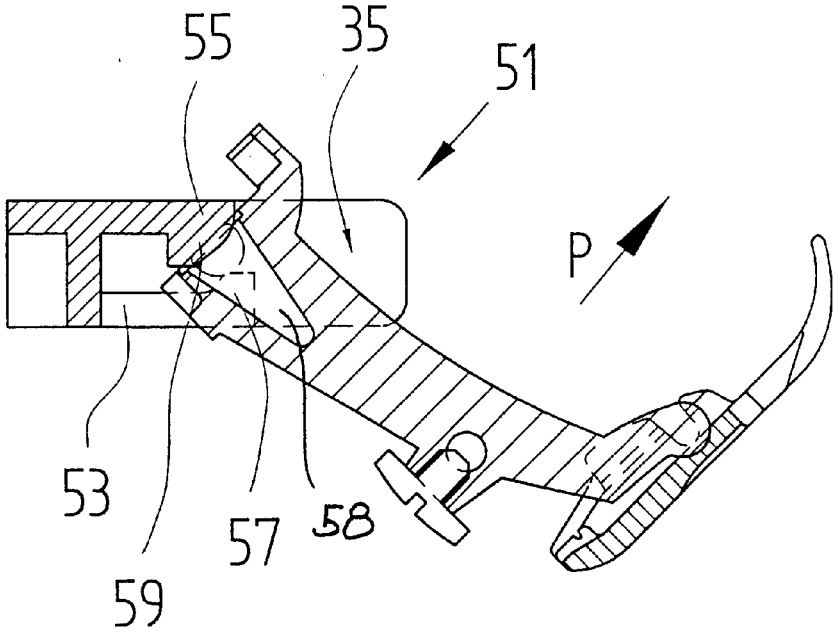

For storing presser feet 51 (see, FIGS. 7 and 8), the receiving shelf 35 comprises a plurality of the spaced, forwardly pointing tabs 53, and the retaining cams 55; the latter each provided above the intermediate space between each two tabs 53, with a vertical spacing from the latter. The upwardly pointing lugs 57 are formed on the ends of the tabs 53, and the downwardly pointing humps 59 on the retaining cams 55. With presser feet 51 suspended, the humps 59 engage the centering bore 58, located at the upper end of the shaft. Presser feet 51 rest with their laterally projecting holding pins 61 on the tabs 53. In, his manner, presser feet 51 are prevented from sliding out of the receiving shelf 35. So as to be able to remove a presser foot 51 from box 1, such presser foot is turned counterclockwise about the axis of the laterally projecting pin 61 in the direction of the arrow P, until the hump 59 slides from the centering bore 58 and the pins 61 can be guided over the lugs 57.

The receiving shelf 35 may slightly deviate from the embodiment shown and described above, depending on the construction of the presser feet 51 and the sewing foot soles without a shaft to be stored. However, the presser foot 51 is basically locked, or released, by a swivelling movement before it can be removed from the receiving shelf 35.

As in conjunction with the shelf 33 for receiving the lower thread bobbin 39, several take-up places disposed next to one another on a rack are formed on the shelf for the presser feet 51, as well.

In order to enlarge the set-up surface area of box 1, which has a low depth, and thereby prevent the latter from overturning, the two swivelling support feet 17 can be swivelled to the rear by approximately 90°. To increase the stability of box 1, its bottom 3 is set at an angle of slightly over 90° in relation to the surfaces of the two doors 9, 11.

In an advantageous embodiment of the present invention, a locking element 63 can be included and made releasable by the touch of a finger, is mounted, for example, on deck 15. Locking element 63 is capable of engaging a corresponding counterpiece on the sewing machine and of retaining box 1, when it is not in use (see, FIG. 1.)

While only several embodiments of the present invention have been shown and described, it will be obvious to those skilled in the art that many modifications may be made to the present invention without departing from the spirit and scope thereof.

What is claimed is:

1. A sewing accessories box, comprising:

a bottom set-up base;

a back wall;

a front wall constructed as a door;

two side walls connecting said back wall and said front wall, and extending from said bottom set-up-base; and, at least one receiving shelf contained within said bottom set-up base, said back wall, said front wall and said two side walls for receiving sewing accessories, said receiving shelf comprising:

lockable means for retaining sewing accessories in a holding and transport position on said receiving shelf; and, means for releasing said lockable means for retaining the sewing accessories held by said lockable means from said holding and transport position to a removal position for removing the sewing accessories from said sewing accessories box.

2. The sewing accessories box according to claim 1, wherein said means for releasing said lockable means for retaining the sewing accessories from said holding and transport position to a removal position includes actuation via a release key.

3. The sewing accessories box according to claim 2, wherein said at least one receiving shelf is a first receiving shelf comprising a plurality of thread bobbin push-in shelves for a lower thread bobbin, wherein each individual bobbin is lockable in said holding and transport position via forces radially acting on the lower thread bobbin and, by actuating said release key, said forces radially acting are cancelled out, and the lower thread bobbin becomes transferable from said holding and transport position to said removal position on said first receiving shelf.

4. The sewing accessories box according to claim 1, wherein said at least one receiving shelf is a first receiving shelf comprising a C-shaped cross-section with a lower leg and an upper leg with said lower leg being longer than said upper leg, and with an end of said upper leg having a retaining rib for positioning a bobbin in said holding and transport position.

5. The sewing accessories box according to claim 4, wherein said lower leg is made of an elastically flexible material and on an end of said lower leg is a release key with a retaining edge for the bobbin in said removal position.

6. The sewing accessories box according to claim 1, wherein said at least one receiving shelf is a first receiving shelf for retaining presser feet, said first receiving shelf having a plurality of spaced-apart forwardly pointing tabs and, with a vertical spacing therefrom, retaining cams located above intermediate spaces between said tabs.

7. The sewing accessories box according to claim 6, wherein said retaining cams have downwardly protruding humps molded thereon, said downwardly protruding humps being engagable with a centering bore on a shaft of the presser feet.

8. The sewing accessories box according to claim 1, wherein said means for releasing said lockable means for retaining the sewing accessories from said holding and transport position to a removal position includes means for a swivel movement of the sewing accessories.

9. The sewing accessories box according to claim 1, wherein said at least one receiving shelf is arranged on a rack with lateral guides.

10. The sewing accessories box according to claim 9, further comprising rails laterally positioned in said sewing accessories box for receiving said at least one receiving shelf.

11. The sewing accessories box according to claim 1, further comprising at least one support foot secured on said bottom set-up base of said sewing accessories box and being pivotable rearwardly about a substantially vertical or horizontal axis.

12. The sewing accessories box according to claim 11, wherein, in said transport position, said at least one support foot is accommodated in a correspondingly shaped trough in said bottom set-up base of said sewing accessories box.

13. The sewing accessories box according to claim 11, wherein, in said transport position, said at least one support foot is accommodated in a correspondingly shaped trough in said back wall of said sewing accessories box.

14. A sewing accessories box, comprising:

a bottom set-up base;

a back wall;

a front wall constructed as a door;

two side walls connecting said back wall and said front wall, and extending from said bottom set-up base; and, at least one receiving shelf contained within said bottom set-up base, said back wall, said front wall and said two side walls for receiving sewing accessories, said receiving shelf comprising:

means for retaining sewing accessories in a holding and transport position on said receiving shelf; and, means for changing, by actuation of via release key, the sewing accessories held by said means for retaining from said holding and transport position to a removal position for removing the sewing accessories from said sewing accessories box, wherein said at least one receiving shelf is a first receiving shelf comprising a plurality of thread bobbin push-in shelves for a lower thread bobbin, in which each individual bobbin is lockable in said holding and transport position via forces radially acting on the lower thread bobbin and, by actuating said release key, said forces radially acting are cancelled out, and the lower thread bobbin becomes transferable from said holding and transport position to said removal position on said first receiving shelf.

15. A sewing accessories box, comprising:

a bottom set-up base;

a back wall;

a front wall constructed as a door;

two side walls connecting said back wall and said front wall, and extending from said bottom set-up base; and, at least one receiving shelf contained within said bottom set-up base, said back wall, said front wall and said two side walls for receiving sewing accessories, said receiving shelf comprising:

means for retaining sewing accessories in a holding and transport position on said receiving shelf; and, means for changing the sewing accessories held by said means for retaining from said holding and transport position to a removal position for removing the sewing accessories from said sewing accessories box, wherein said at least one receiving shelf is a first receiving shelf comprising a C-shaped cross-section with a lower leg and an upper leg with said lower leg being longer than said upper leg, and with an end of said upper leg having a retaining rib for positioning a bobbin in said holding and transport position.

16. The sewing accessories box according to claim 15, wherein said lower leg is made of an elastically flexible material and on an end of said lower leg is a release key with a retaining edge for the bobbin in said removal position.

17. A sewing accessories box, comprising:

a bottom set-up base;

a back wall;

a front wall constructed as a door;

two side walls connecting said back wall and said front wall, and extending from said bottom set-up base; and, at least one receiving shelf contained within said bottom set-up base, said back wall, said front wall and said two side walls for receiving sewing accessories, said receiving shelf comprising:

means for retaining sewing accessories in a holding and transport position on said receiving shelf; and, means for changing the sewing accessories held by said means for retaining from said holding and transport position to a removal position for removing the sewing accessories from said sewing accessories box, wherein said at least one receiving shelf is a first receiving shelf for retaining presser feet, said first receiving shelf having a plurality of spaced-apart forwardly pointing tabs and, with a vertical spacing therefrom, retaining cams located above intermediate spaces between said tabs.

18. The sewing accessories box according to claim 17, wherein said retaining cams have downwardly protruding humps molded thereon, said downwardly protruding humps being engagable with a centering bore on a shaft of the presser feet.

19. A sewing accessories box, comprising:

a bottom set-up base;

a back wall;

a front wall constructed as a door;

two side walls connecting said back wall and said front wall, and extending from said bottom set-up base; and, at least one receiving shelf contained within said bottom set-up base, said back wall, said front wall and said two side walls for receiving sewing accessories, said receiving shelf comprising:

means for retaining sewing accessories in a holding and transport position on said receiving shelf; and, means for changing the sewing accessories held by said means for retaining from said holding and transport position to a removal position for removing the sewing accessories from said sewing accessories box, said means for changing including means for a swivel movement of the sewing accessories.

* * * * *